US007428887B2

(12) United States Patent
Sugie et al.

(10) Patent No.: US 7,428,887 B2
(45) Date of Patent: Sep. 30, 2008

(54) ELECTROMAGNETICALLY DRIVEN VALVE

(75) Inventors: Yutaka Sugie, Aichi-ken (JP); Masahiko Asano, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 45 days.

(21) Appl. No.: 11/492,826

(22) Filed: Jul. 26, 2006

(65) Prior Publication Data

US 2007/0028871 A1 Feb. 8, 2007

(30) Foreign Application Priority Data

Aug. 2, 2005 (JP) ..... 2005-224438

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.15, 129.16
See application file for complete search history.

(56) References Cited

U.S. PATENT DOCUMENTS

| | | | | |
|---|---|---|---|---|
| 5,772,179 | A | 6/1998 | Morinigo et al. | |
| 6,467,441 | B2 | 10/2002 | Cristiani et al. | |
| 6,516,758 | B1 * | 2/2003 | Leiber | 123/90.11 |
| 6,546,904 | B2 | 4/2003 | Marchioni et al. | |
| 6,571,823 | B2 * | 6/2003 | Rossi et al. | 137/554 |
| 6,718,918 | B2 | 4/2004 | Meintschel et al. | |
| 2001/0054401 | A1 | 12/2001 | Cristiani et al. | |
| 2002/0020372 | A1 | 2/2002 | Stolk et al. | |
| 2002/0057154 | A1 | 5/2002 | Keck | |

FOREIGN PATENT DOCUMENTS

| | | | |
|---|---|---|---|
| DE | 199 55 079 | A1 | 5/2000 |
| DE | 199 55 067 | A1 | 5/2001 |
| DE | 100 00 045 | A1 | 7/2001 |
| DE | 100 20 896 | A1 | 10/2001 |
| DE | 100 25 491 | A1 | 12/2001 |
| DE | 101 26 025 | A1 | 1/2002 |
| DE | 100 53 596 | A1 | 5/2002 |
| DE | 100 60 538 | A1 | 6/2002 |
| DE | 102 20 788 | A1 | 11/2003 |
| DE | 102 21 015 | A1 | 11/2003 |
| EP | 1 098 072 | A1 | 11/2000 |
| EP | 1 087 110 | A1 | 3/2001 |
| EP | 1 136 660 | A1 | 9/2001 |

(Continued)

*Primary Examiner*—Ching Chang
(74) *Attorney, Agent, or Firm*—Sughrue Mion, PLLC

(57) ABSTRACT

An electromagnetically driven valve includes a valve element, a main body, a disc, and a lower electromagnet. The valve element includes a valve stem, and is reciprocated in the direction in which the valve stem extends. The main body is provided at a position distant from the valve element. The disc includes a driving end that is moved in conjunction with the valve stem, and a pivoting end that is supported by the main body such that the pivoting end can be oscillated. The disc is oscillated around a central axis that extends at the pivoting end. The lower electromagnet is disposed so as to face the disc. The lower electromagnet includes a core made of magnetic material, and a coil wound in the core. The central axis is surrounded by a cylindrical bearing portion of the disc, which is made of magnetic material. The core has a cylindrical surface that faces the bearing portion.

14 Claims, 13 Drawing Sheets

FOREIGN PATENT DOCUMENTS

| | | | |
|---|---|---|---|
| EP | 1 152 129 | A1 | 11/2001 |
| EP | 1 209 328 | A2 | 5/2002 |
| FR | 2 812 026 | A1 | 1/2002 |
| FR | 2 860 912 | A1 | 4/2005 |
| WO | WO 01/59267 | A1 | 8/2001 |
| WO | WO 2006/018931 | A1 | 2/2006 |

* cited by examiner

ELECTROMAGNETICALLY DRIVEN VALVE

INCORPORATION BY REFERENCE

The disclosure of Japanese Patent Application No. 2005-224438 filed on Aug. 2, 2005 including the specification, drawings and abstract is incorporated herein by reference in its entirety.

BACKGROUND OF THE INVENTION

1. Field of the Invention

The invention generally relates to an electromagnetically driven valve. More specifically, the invention may be applied, for example, to a pivot-type electromagnetically driven valve for an internal combustion engine, which is operated by an elastic force and an electromagnetic force.

2. Description of the Related Art

U.S. Pat. No. 6,467,441 describes an example of an electromagnetically driven valve. In a conventional electromagnetically driven valve, a gap between a disc and an electromagnet is large, and an electromagnetic force is small on a central-axis side. Therefore, it is difficult to obtain a large initial driving force. Further, the amount of electric current needed in order to obtain a large initial driving force is large. This increases the amount of consumed electric power.

In view of the above, it is an object of the invention to provide an electromagnetically driven valve that can reduce the amount of consumed electric power and sill provide a sufficient driving force.

SUMMARY OF THE INVENTION

An electromagnetically driven valve according to the invention is operated by electromagnetic force. The electromagnetically driven valve includes a valve element, an oscillating member, a supporting member, and an electromagnet. The valve element includes a valve shaft, and is reciprocated in a direction in which the valve shaft extends. The oscillating member extends from a driving end that is moved in conjunction with the valve element to a pivoting end. The oscillating member is oscillated around a central axis that extends at the pivoting end. The support member supports the oscillating member. The electromagnet is provided so as to face the oscillating member. The electromagnet includes a core made of magnetic material, and a coil wound in the core. The central axis is surrounded by a cylindrical portion of the oscillating member, which is made of magnetic material. The core has a cylindrical portion that faces the cylindrical portion of the oscillating member.

In the electromagnetically driven valve having the aforementioned configuration, the central axis is surrounded by the cylindrical portion and the core also has the cylindrical portion. Therefore, even when the oscillating member is driven to the maximum extent, a distance between the two cylindrical portions can be maintained at a small constant value, and a required electromagnetic force can be obtained. As a result, the amount of consumed electric power can be reduced.

In the electromagnetically driven valve, the electromagnet may include an upper electromagnet that is positioned above the oscillating member and a lower electromagnet that is positioned below the oscillating member. A protrusion made of magnetic material, which extends toward the oscillating member, may be provided in each of the cores of the upper electromagnet and the lower electromagnet at a portion on a driving end side. When the oscillating member is placed at a neutral position, a distance between the cylindrical portion of the oscillating member and the cylindrical portion of the core of the upper electromagnet may be different from a distance between the cylindrical portion of the oscillating member and the cylindrical portion of the core of the lower electromagnet, and a distance between the protrusion provided in the core of the upper electromagnet at the portion on the driving end side and the oscillating member may be different from a distance between the protrusion provided in the core of the lower electromagnet at the portion on the driving end side and the oscillating member. With this configuration, when the oscillating member is placed at the neutral position, the electromagnetic force in an upper area is made larger than that in a lower area, or the electromagnetic force in the lower area is made larger than that in the upper area due to the aforementioned differences in the distance. As a result, the amount of consumed electric power can be reduced when operation of the electromagnetically driven valve is started.

A distance between the cylindrical portion of the oscillating member and the cylindrical portion of the core may be changed while the oscillating member is oscillated. With this configuration, a required electromagnetic force can be obtained at a predetermined rotational angle.

A slit may be formed in the cylindrical portion of the oscillating member. With this configuration, magnetic flux leakage can be reduced, and the electromagnetic force can be obtained.

According to the invention, it is possible to provide an electromagnetically driven valve that can reduce the amount of consumed electric power yet still provide a sufficient driving force.

Hereinafter, embodiments of the invention will be described with reference to drawings. In the following embodiments, the same and corresponding portions are denoted by the same reference numerals, and the description thereof will not be repeated.

BRIEF DESCRIPTION OF THE DRAWINGS

The foregoing and further objects, features and advantages of the invention will become apparent from the following description of example embodiments with reference to the accompanying drawings, wherein the same or corresponding portion are denoted by the same reference numerals and wherein.

DETAILED DESCRIPTION OF THE PREFERRED EMBODIMENTS

Figure 1:
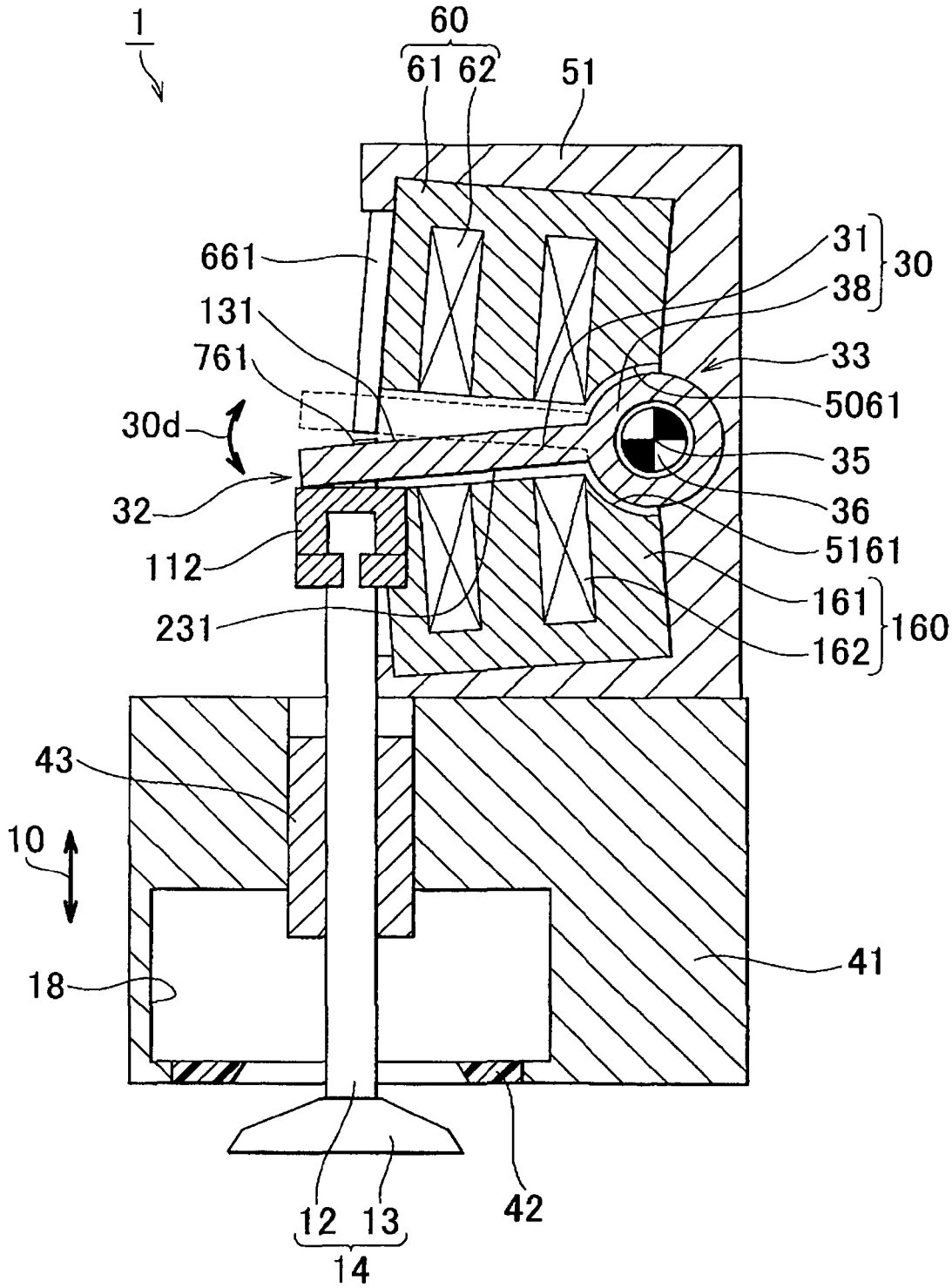
FIG. 1 is a cross-sectional view of an electromagnetically driven valve according to a first embodiment.

FIG. 1 is a cross-sectional view of an electromagnetically driven valve according to a first embodiment. As shown in FIG. 1, an electromagnetically driven valve 1 includes a main body 51, an upper electromagnet 60, a lower electromagnet 160, a disc 30, and a valve element 14. The upper electromagnet 60 and the lower electromagnet 160 are fitted to the main body 51. The disc 30 is provided between the upper electromagnet 60 and the lower electromagnet 160. The valve element 14 is driven by the disc 30.

The main body 51 has a U-shape cross section, and serves as a base member. Various components are fitted to the main body 51. The upper electromagnet 60 includes a core 61 made of magnetic material, and a coil 62 wound in the core 61. The lower electromagnet 160 includes a core 161 made of magnetic material, and a coil 162 wound in the core 161. When each of the coils 62 and 162 is energized, a magnetic field is generated. The disc 30 is driven by the magnetic field. The disc 30 is provided between the upper electromagnet 60 and the lower electromagnet 160, and attracted to the upper electromagnet 60 or the lower electromagnet 160 by the attraction force thereof. As a result, the disc 30 is reciprocated between the upper electromagnet 60 and the lower electromagnet 160. The reciprocating motion of the disc 30 is transmitted to a valve stem 12.

The electromagnetically driven valve 1 is operated by an electromagnetic force. The electromagnetically driven valve 1 includes a valve element 14, the main body 51, the disc 30, and the upper electromagnet 60 and the lower electromagnet 160. The valve element 14 includes the valve stem 12 that serves as the valve shaft, and is reciprocated in a direction in which the valve stem 12 extends (i.e., the direction indicated by an arrow 10). The main body 51, which serves as the support member, is provided at a position distant from the valve element 14. The disc 30 includes a driving end 32 that is moved in conjunction with the valve stem 12, and a pivoting end 33 that is supported by the main body 51 such that the pivoting end 33 can be oscillated. The disc 30 is oscillated or pivoted around a central axis 35 that extends at the pivoting end 33. The disc 30 serves as the oscillating member. The upper electromagnet 60 and the lower electromagnet 160 are disposed so as to face the disc 30. The upper electromagnet 60 includes the core 61 made of magnetic material, and the coil 62 wound in the core 61. The lower electromagnet 160 includes the core 161 made of magnetic material, and the coil 162 wound in the core 161. The central axis 35 is surrounded by a cylindrical bearing portion 38 of the disc 30, which is made of magnetic material. The core 61 has a cylindrical surface 5061 that faces the bearing portion 38. The core 161 has a cylindrical surface 5161 that faces the bearing portion 38. The electrically-driven valve 1 in this embodiment constitutes an intake valve or an exhaust valve of an internal combustion engine such as a gasoline engine or a diesel engine. In this embodiment, the valve element 14 is used as an intake valve provided in an intake port 18. However, the invention may be applied to the case, for example, where the valve element 14 is used as an exhaust valve.

The electromagnetically driven valve 1 is a pivot-type electromagnetically driven valve. The disc 30 is used as a motion mechanism. The main body 51 is provided on a cylinder head 41. The lower electromagnet 160 is provided in a lower area of the main body 51. The upper electromagnet 60 is provided in an upper area of the main body 51. The lower electromagnet 160 includes the core 161 made of iron, and the coil 162 wound in the core 161. By supplying electric current to the coil 162, the magnetic field is generated around the coil 162. The disc 30 can be attracted to the lower electromagnet 160 by this magnetic field. The upper electromagnet 60 includes the core 61 made of iron, and the coil 62 wound in the core 61. By supplying electric current to the coil 62, the magnetic field is generated around the coil 62. The disc 30 can be attracted to the upper electromagnet 60 by this magnet field.

The coil 62 of the upper electromagnet 60 may be connected to the coil 162 of the lower electromagnet 160. Alternatively, the coil 62 may be separated from the coil 162. The number of turns of the coil 62 wound in the core 61 is not limited to a specific number. Also, the number of turns of the coil 162 wound in the core 161 is not limited to a specific number.

The disc 30 includes an arm portion 31 and the bearing portion 38. The arm portion 31 extends from the driving end 32 to the pivoting end 33. The arm portion 31 is attracted by the upper electromagnet 60 or the lower electromagnet 160. As a result, the arm portion 31 is oscillated (pivoted) in a direction shown by an arrow 30*d*. The bearing portion 38 is fitted to an end portion of the arm portion 31. The arm portion 31 is pivoted around the bearing portion 38. An upper surface 131 of the arm portion 31 can contact the upper electromagnet 60. A lower surface 231 of the arm portion 31 can contact the lower electromagnet 160. The lower surface 231 is in contact with a non-magnetic body 112.

The bearing portion 38 has a cylindrical shape. A torsion bar 36 is provided inside the bearing portion 38. The end portion of the torsion bar 36 is fitted to the main body 51 by spline fitting. The other end portion of the torsion bar 36 is fitted to the bearing portion 38. Thus, when the bearing portion 38 is about to pivot, the force resisting the movement is applied to the bearing portion 38 from the torsion bar 36. Thus, the bearing portion 38 is always urged toward a neutral position.

The driving end 32 of the disc 30 presses the valve stem 12 via the non-magnetic body 112. The valve stem 12 is guided by a stem guide 43.

The main body 51 is provided on the cylinder head 41. Intake ports 18 are provided in a lower area of the cylinder head 41. Intake air is introduced to a combustion chamber through each intake port 18. That is, air-fuel mixture or air passes through each intake port 18. A valve seat 42 is provided between the intake port 18 and the combustion chamber. The valve seat 42 provides increased sealability of the valve element 14.

The valve element 14 that is used as an intake valve is fitted to the cylinder head 41. The valve element 14 includes the valve stem 12 and a bell portion 13. The valve stem 12 extends in the longitudinal direction. The bell portion 13 is provided at the end of the valve stem 12. The valve stem 12 is guided by the stem guide 43. The valve element 14 can be reciprocated in the direction shown by the arrow 10.

The upper electromagnet 60 and the lower electromagnet 160 are provided with protrusions 661 and 761, respectively.

Each of the protrusions 661 and 761 is made of magnetic material. The protrusion 661 and 761 extend toward the disc 30.

Figure 2:
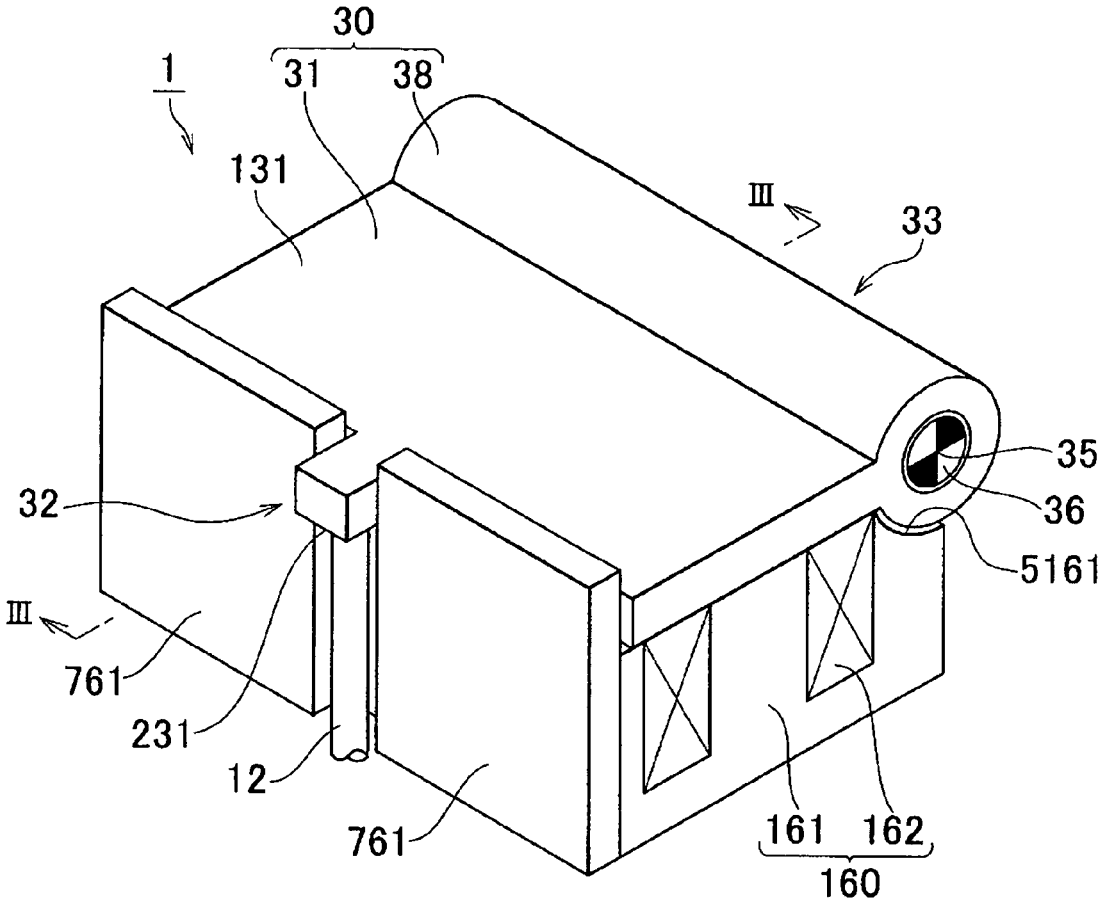
FIG. 2 is a perspective view of a lower electromagnet and a disc shown in FIG. 1.

FIG. 2 is a perspective view of the lower electromagnet and the disc in FIG. 1. As shown in FIG. 2, the lower electromagnet 160 includes the core 161 and the coil 162. The core 161 includes concave portions. The coil 162 is fitted in the concave portions. The protrusion 761 made of magnetic material is welded to the core 161 made of electromagnetic steep plate or the like. The protrusion 761 extends on a driving end 32 side (i.e., the side closer to the driving end 32 than to the pivoting end 33). The protrusion 761 is provided to reduce the distance (gap) between the lower electromagnet 160 and the disc 30. The protrusion 761 does not necessarily need to be provided. The protrusion 661 shown in FIG. 1 does not necessarily need to be provided either. The protrusion 761 does not contact the disc 30.

Figure 3:
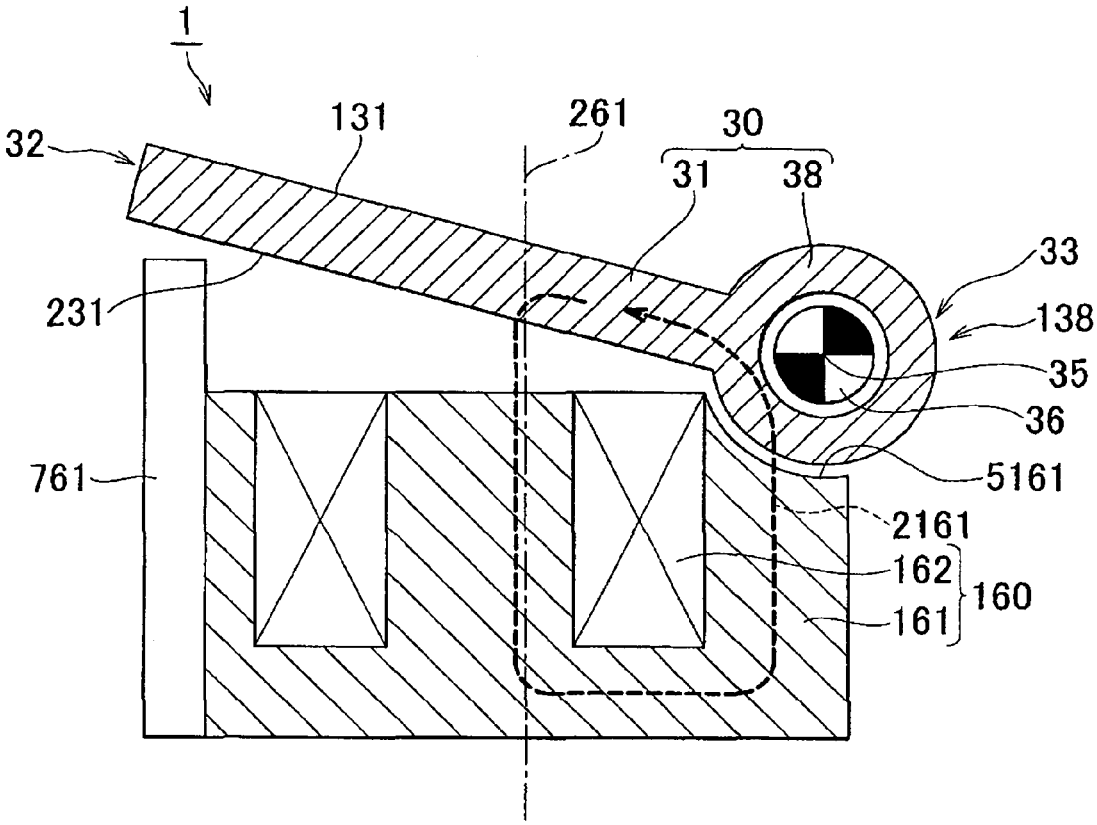
FIG. 3 is an enlarged cross-sectional view of the lower electromagnet and the disc.

FIG. 3 is an enlarged cross-sectional view of the lower electromagnet and the disc. As shown in FIG. 3, the lower electromagnet 160 includes the core 161 having an E-shape cross section, and the coil 162 wound in the core 161. In the core 161, the cylindrical surface 5161 is formed near the bearing portion 38. The cylindrical surface 5161 is formed along the outer surface of the bearing portion 38. The cylindrical surface 5161 constitutes a portion of a magnetic circuit 2161 shown by a dashed line. The portion through which the magnetic circuit 2161 passes is made of magnetic material. Because this magnetic circuit is formed, the arm portion 31 is attracted to the lower electromagnet 160. As the gap (distance) between the disc 30 and the lower electromagnet 160 becomes smaller, a greater electromagnetic force is applied. In this embodiment, the torsion bar 36 is surrounded by the cylindrical bearing portion 38 made of magnetic material. The cylindrical surface 5161 of the core 161 faces the bearing portion 38. The distance between the cylindrical surface 5161 and the bearing portion 38 is short and constant. Therefore, the gap is always small, irrespective of the position of the disc 30. Thus, the density of magnetic flux is increased. That is, as shown in FIG. 3, a large electromagnetic force is obtained when the disc 30 does not contact the core 161. As a result, the amount of used electric current and the amount of consumed electric power are reduced.

Figure 4:
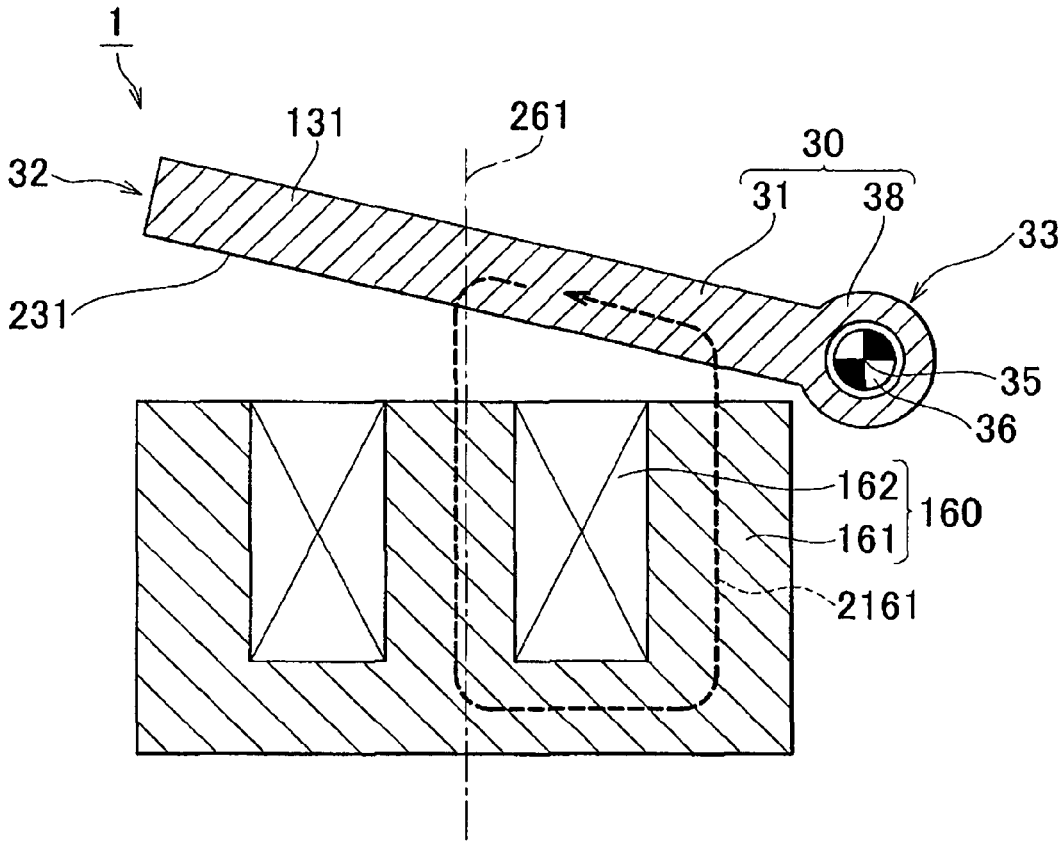
FIG. 4 is a cross-sectional view of a lower electromagnet and a disc according to a comparative example.

FIG. 4 is a cross-sectional view of a lower electromagnet and a conventional disc arrangement. As shown in FIG. 4, in the conventional configuration, when the disc 30 is lifted, the gap between the disc 30 and a center portion of the core 161 and the gap between the disc 30 and a portion of the core 161 on a pivoting end 33 side (i.e., the side closer to the pivoting end 33 than to the driving end 32) is increased relative to the embodiment shown in FIG. 1. As a result, the electromagnetic force decreases. In order to compensate for the decrease in the electromagnetic force, a large amount of electric current is necessary. This increases the amount of consumed electric power.

Next, the operation of the electromagnetically driven valve according to the first embodiment will be described. When the electromagnetically driven valve 1 is operated, electric current is supplied to the coil 62 that constitutes the upper electromagnet 60 or the coil 162 that constitutes the lower electromagnet 160. In the first embodiment, for example, electric current is supplied to the coil 62. As a result, the magnetic field is generated around the coil 62, and the arm portion 31 of the disc 30, which is made of magnetic material, is attracted to the upper electromagnet 60. The arm portion 31 is pivoted upward, the torsion bar 36 is twisted, and the torsion bar 30 is about to move the arm portion 31 in the opposite direction. However, because the attraction force of the upper electromagnet 60 is strong, the arm portion 31 is pivoted upward, and finally, the upper surface 131 contacts the upper electromagnet 60. As the arm portion 31 is moved upward, the non-magnetic body 112 and the valve stem 12 are also moved upward.

When the valve element 14 is placed in an opened position, the arm portion 31 needs to be moved downward. In this case, supply of electric current to the coil 62 is stopped, or the amount of electric current supplied to the coil 62 is decreased. As a result, the electromagnetic force that acts between the electromagnet 60 and the arm portion 31 is decreased. Because the torsional force is applied to the arm portion 31 by the torsion bar 36, the torsional force (elastic force) overcomes the electromagnetic force, and the arm portion 31 is moved to a neutral position in FIG. 1. Then, electric current is supplied to the coil 162 that constitutes the lower electromagnet 160. As a result, the magnetic field is generated around the coil 162, and the arm portion 31 made of magnetic material is attracted to the lower electromagnet 160. At this time, the arm portion 31 is moved downward allowing the valve stem 12 of the valve element 14 to move downward. The attraction force of the coil 162 overcomes the torsional force of the torsion bar 36. Finally, the lower surface 231 contacts the lower electromagnet 160. At this time, the valve element 14 is moved downward.

By moving the arm portion 31 upward and downward repeatedly in this manner, the arm portion 31 is pivoted in the direction shown by the arrow 30*d*. When the arm portion 31 is pivoted, the bearing portion 38 connected to the arm portion 31 is also pivoted.

According to the first embodiment, the torsion bar 36 is surrounded by the cylindrical bearing portion 38 made of magnetic material. With this configuration, the gap is decreased, and the electromagnetic force is increased. As a result, the amount of consumed electric power can be reduced.

Figure 5:
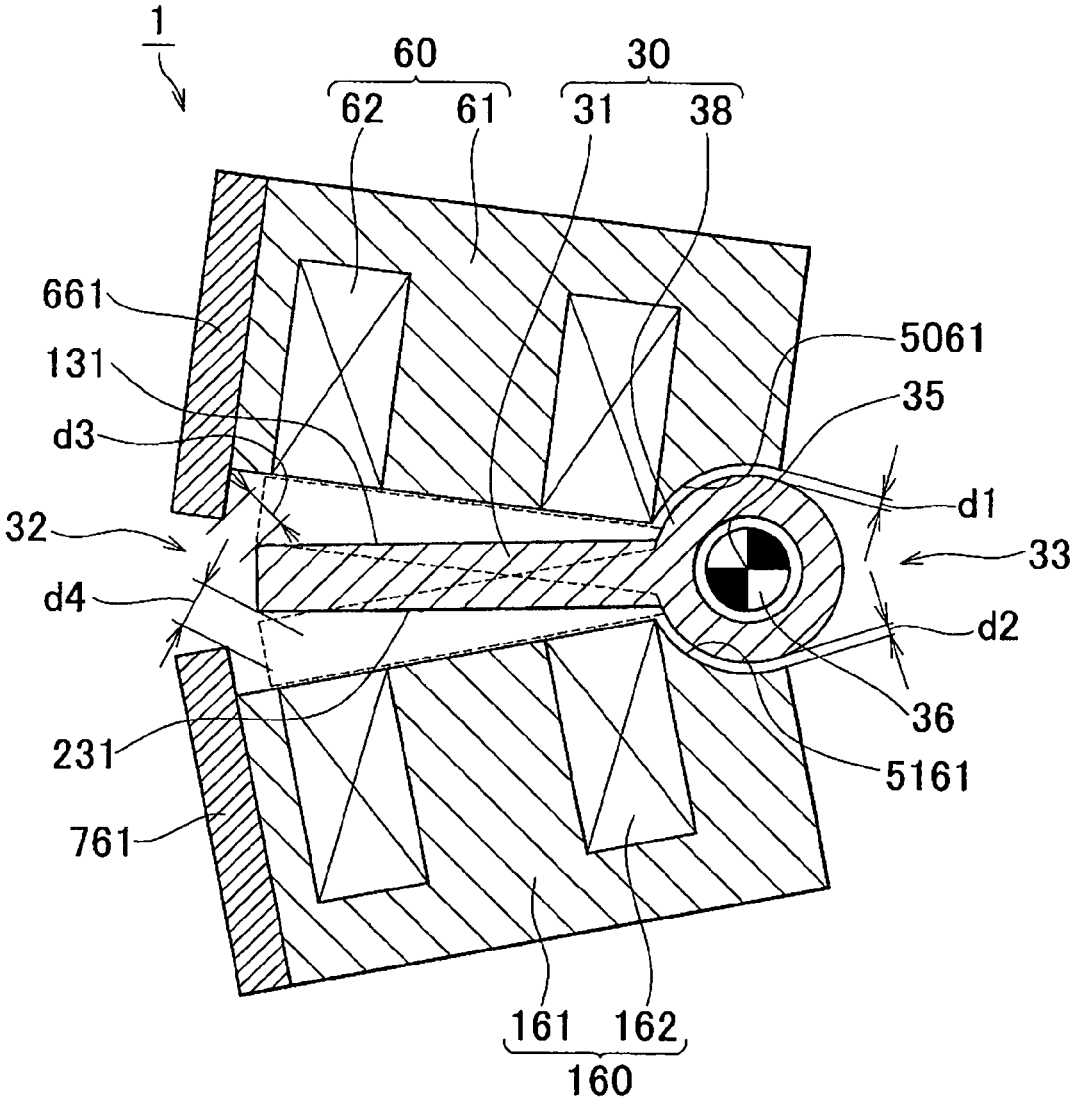
FIG. 5 is a cross-sectional view of an electromagnetically driven valve according to a second embodiment.

FIG. 5 is a cross-sectional view of an electromagnetically driven valve according to a second embodiment. As shown in FIG. 5, in the electromagnetically driven valve according to the second embodiment, an upper gap d1 is located differently from a lower gap d2, and an upper gap d3 is located differently from a lower gap d4. The upper gap d1 is the gap (distance) between the cylindrical surface 5061 of the core 61 and the bearing portion 38. The lower gap d2 is the gap (distance) between the surface 5161 of the core 161 of the lower electromagnet 160 and the bearing portion 38. The upper gap d3 is the gap (distance) between the protrusion 661 and the arm portion 31. The lower gap (distance) d4 is the gap (distance) between the protrusion 761 and the arm portion 31. The gap d1 is smaller than the gap d2. The gap d3 is smaller than the gap d4. The electromagnetically driven valve 1 according to the second embodiment includes the protrusions 661 and 761. The protrusion 661 is provided in the upper electromagnet 60 at a portion on the driving end 32 side, and the protrusion 761 is provided in the lower electromagnet 160 at a portion on the driving end 32 side. The protrusions 661 and 761 extend toward the disc 30. When the disc 30 is placed in the neutral position, the upper gap d1 between the cylindrical bearing portion 38 of the disc 30 and the cylindrical surface 5061 of the core 61 is different from the lower gap d2 between the cylindrical bearing portion 38 and the cylindrical surface 5161 of the core 161. The upper gap d3 between the protrusion 661 provided in the upper core 61 at the portion on the driving end 32 side and the arm portion 31 is different from the lower gap d4 between the protrusion 761 provided in the lower core 161 at the portion on the driving end 32 side and the arm portion 31. In this particular embodiment, the upper gap d1 is smaller than the lower gap d2, and the upper gap d3 is smaller than the lower gap d4. However, the lower gap d2 may be smaller than the upper gap d1, and the lower gap d4 may be smaller than the upper gap d3. By making the upper gap d1 between the upper core 61 and the bearing portion 38 different from the lower gap d2 between the lower core 161 and the bearing portion 38, and making the upper gap d3 between the upper core 61 and the arm portion 31 different from the lower gap d4 between the lower core 161 and the arm portion 31, the electromagnetic force in an upper area is made different from that in a lower area. As a result, the amount of used electric current is reduced, and the amount of consumed electric power is reduced when the operation of the electromagnetically driven valve 1 is started. The reduction in electric power is now described in connection with FIG. 6.

Figure 6:
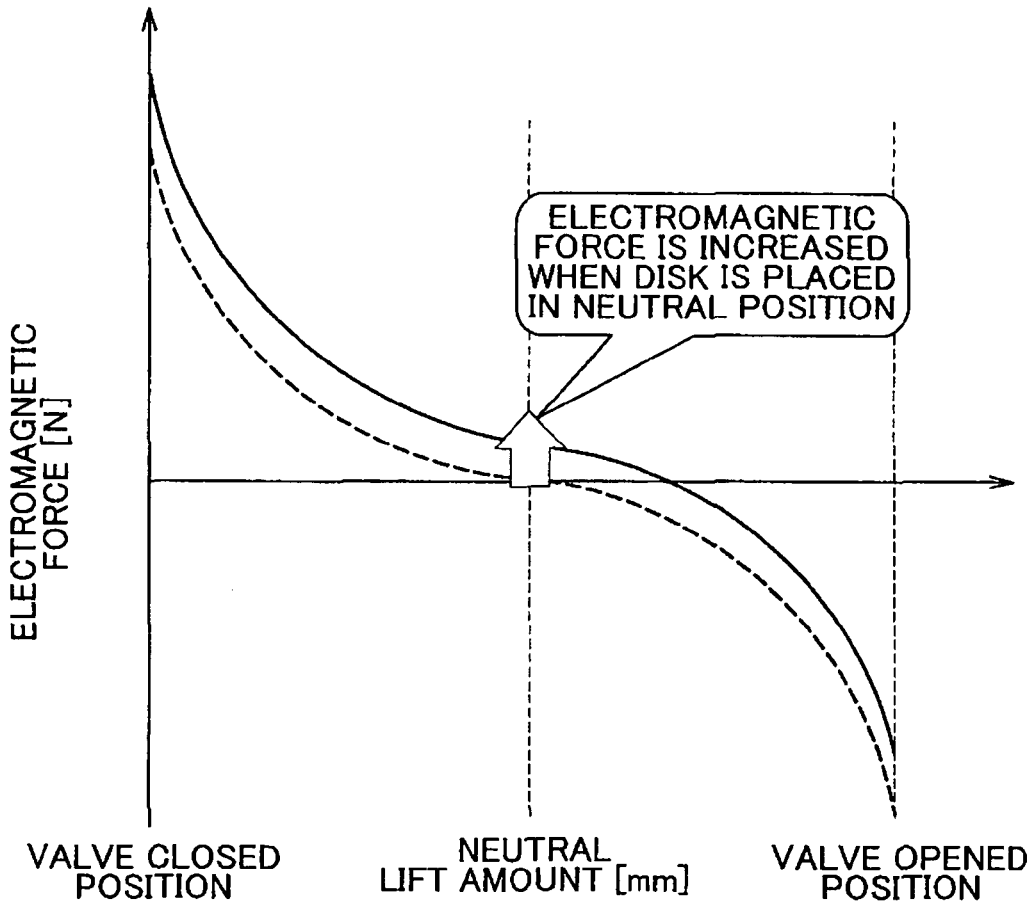
FIG. 6 is a graph showing the relation between a lift amount and an electromagnetic force in the electromagnetically driven valve shown in FIG. 5.

FIG. 6 is a graph showing the relation between a lift amount and the electromagnetic force in the electromagnetically driven valve shown in FIG. 5. In FIG. 6, a dashed line shows the relation between the lift amount and the electromagnetic force in an electromagnetically driven valve in which the upper gaps are equal to the lower gaps. A solid line shows the relation between the lift amount and the electromagnetic force in the electromagnetically driven valve shown in FIG. 5. As shown in FIG. 6, in the electromagnetically driven valve 1 according to the second embodiment of FIG. 5, the electromagnetic force is large when the disc 30 is placed at the neutral position. Because the upper gaps d1 and d3 are small, a large electromagnetic force acts in the upper area when the disc 30 is placed at the neutral position. That is, a large electromagnetic force can be generated at the initial stage (at the neutral position). This reduces the amount of consumed electric power.

Figure 7:
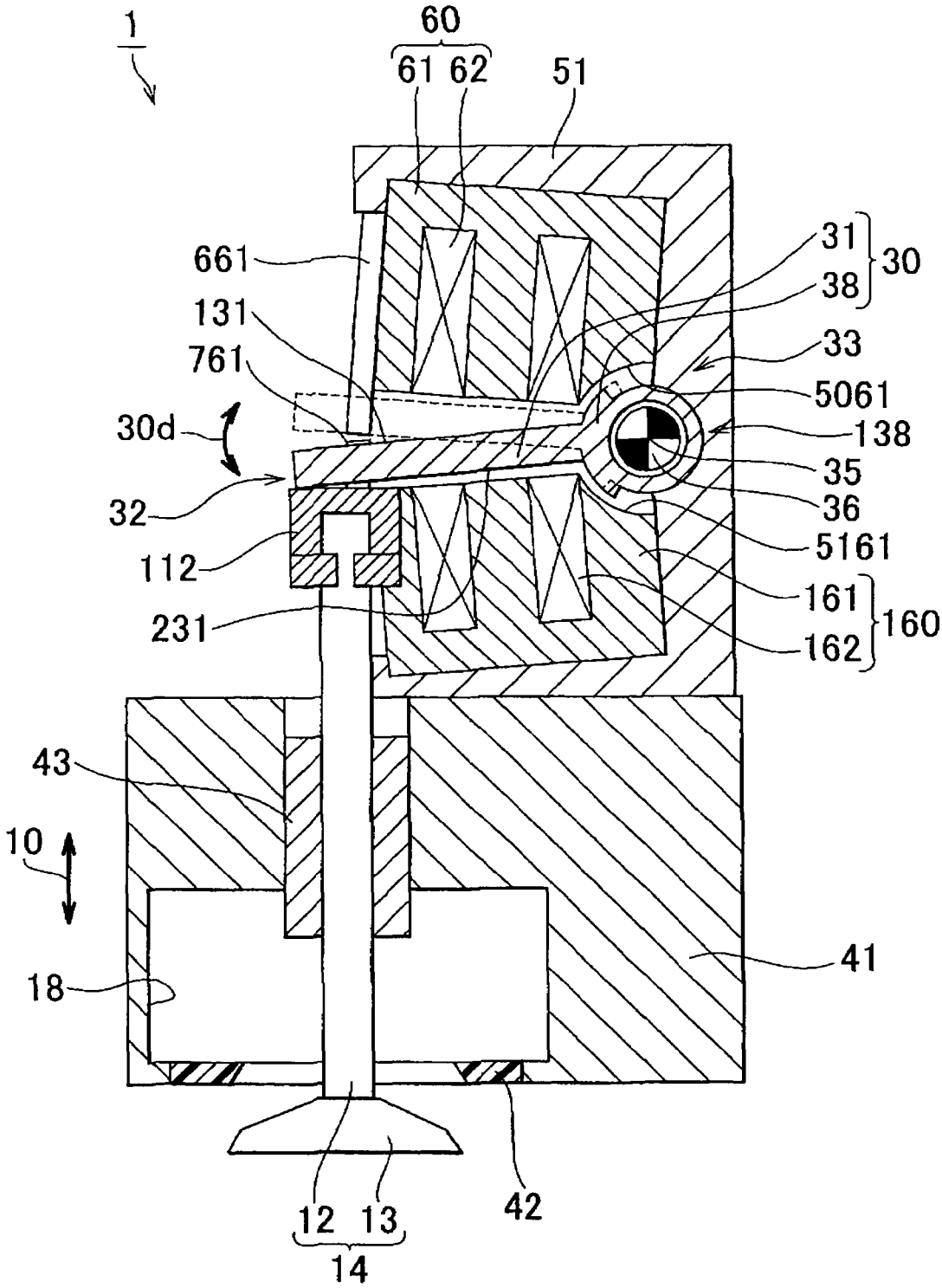
FIG. 7 is a cross-sectional view of an electromagnetically driven valve according a third embodiment.

FIG. 7 is a cross-sectional view of an electromagnetically driven valve 1 according to a third embodiment. As shown in FIG. 7, the electromagnetically driven valve 1 according to the third embodiment is different from the electromagnetically driven valve 1 according to the first embodiment in that a concave portion 138 is provided in the bearing portion 38. The concave portion 138 is provided in the bearing portion 38 at a portion on a main body 51 side. The external diameter is reduced at this portion.

Figure 8:
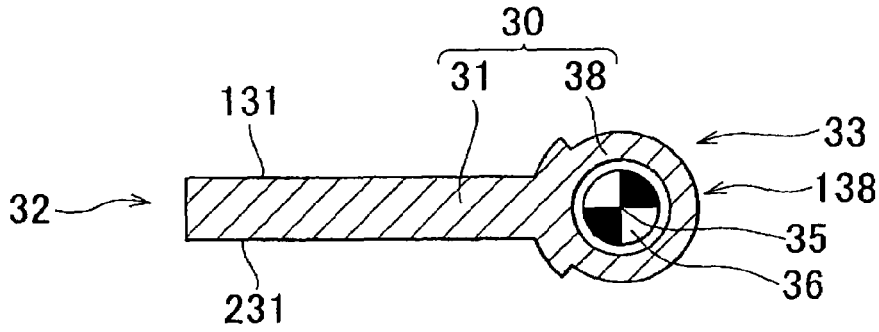
FIG. 8 is an enlarged cross-sectional view of a disc shown in FIG. 7.

FIG. 8 is an enlarged cross-sectional view of the disc shown in FIG. 7. As shown in FIG. 8, the concave portion 138 is provided as an uneven portion in the cylindrical surface of the bearing portion 38 of the disc 30. Further, the central axis 35 is offset from the center of the cylinder. Accordingly, the gap between the cylindrical surface 5061 of the core 61 and the outer surface of the bearing portion 38 and the gap between the cylindrical surface 5161 of the core 161 and the outer surface of the bearing portion 38 in FIG. 7 changes as the disc 30 is lifted. In the embodiment shown in FIG. 7, the central axis 35 is offset from the cylinder center. However, the central axis 35 does not necessarily need to be offset from the center of the cylinder.

Figure 9:
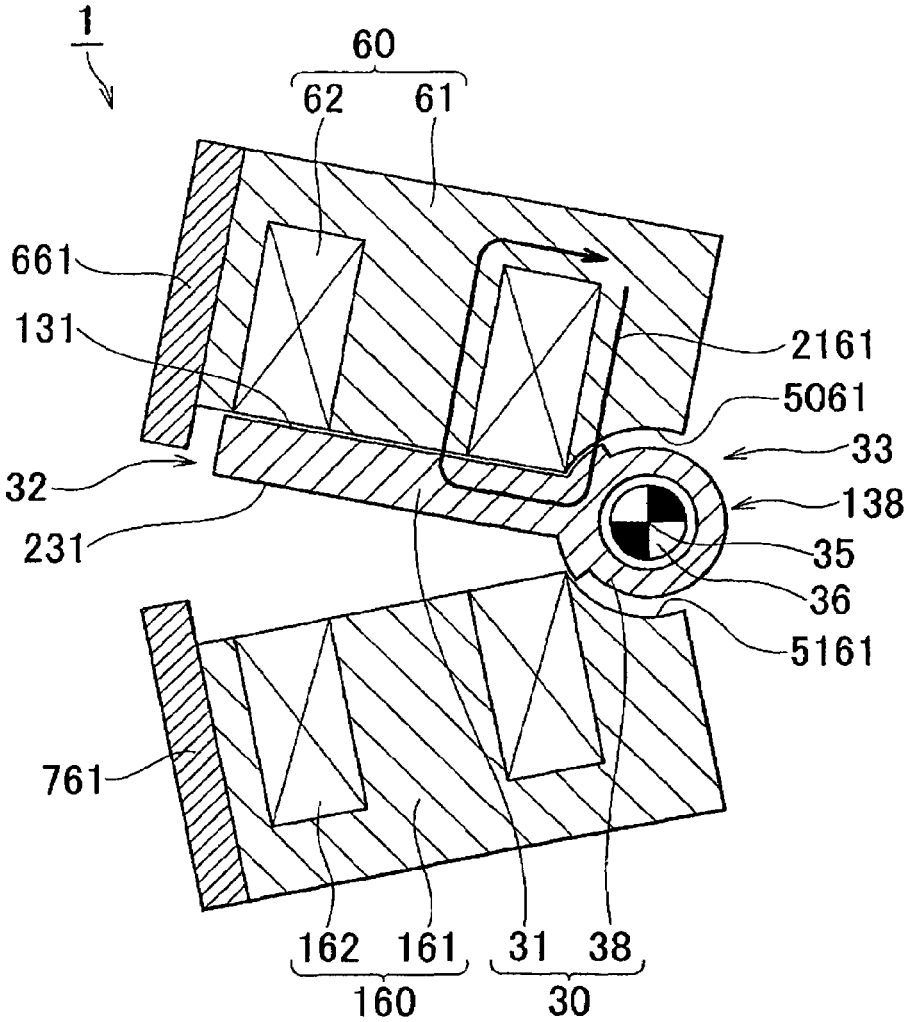
FIG. 9 is a cross-sectional view describing operation of the electromagnetically driven valve shown in FIG. 7.
Figure 10:
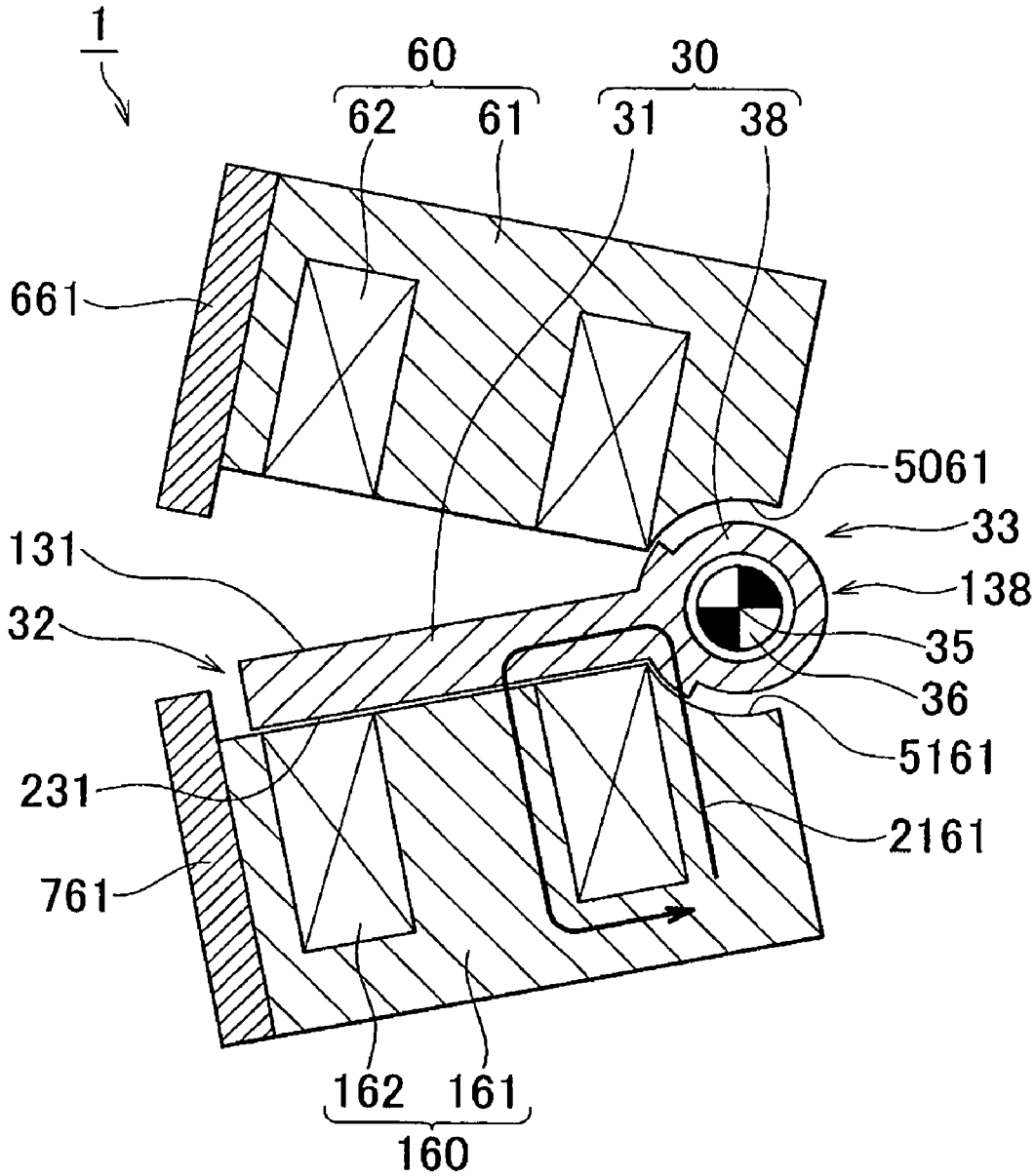
FIG. 10 is a cross-sectional view describing operation of the electromagnetically driven valve shown in FIG 7.

Each of FIG. 9 and FIG. 10 is a cross-sectional view describing operation of the electromagnetically driven valve shown in FIG. 7. When the valve element 14 is placed in the closed position, the disc 30 is attracted to the upper electromagnet 60 as shown in FIG. 9. In this case, the magnetic circuit 2161 passes through the core 61, the bearing portion 38, and the arm portion 31. At this time, the gap (distance) between the cylindrical surface 5061 of the upper magnet 60 and the bearing portion 38 is small. Therefore, the magnetic circuit can easily pass through this gap. Meanwhile, the gap between the cylindrical surface 5161 of the lower electromagnet 160 and the bearing portion 38 is large. Therefore, the magnetic circuit is not generated in the lower electromagnet 160.

In contrast to FIG. 9, when the valve element 14 is placed in the opened position, the gap (distance) between the core 161 of the lower electromagnet 160 and the bearing portion 38 is small, and the gap (distance) between the core 61 of the upper electromagnet 60 and the bearing portion 38 is large, as shown in FIG. 10. Accordingly, the magnetic circuit 2161 is reliably formed in the lower magnet 160, and the magnetic circuit is not formed in the upper electromagnet 60.

In the electromagnetically driven valve 1 having the aforementioned configuration, the electromagnetic force can be increased, and the amount of electric current and the amount of consumed electric power can be reduced by changing the gap between the cylindrical surface 5061 of the upper electromagnet 60 and the bearing portion 36, and the gap between the cylindrical surface 5161 of the lower electromagnet 160 and the bearing portion 36.

Figure 11:
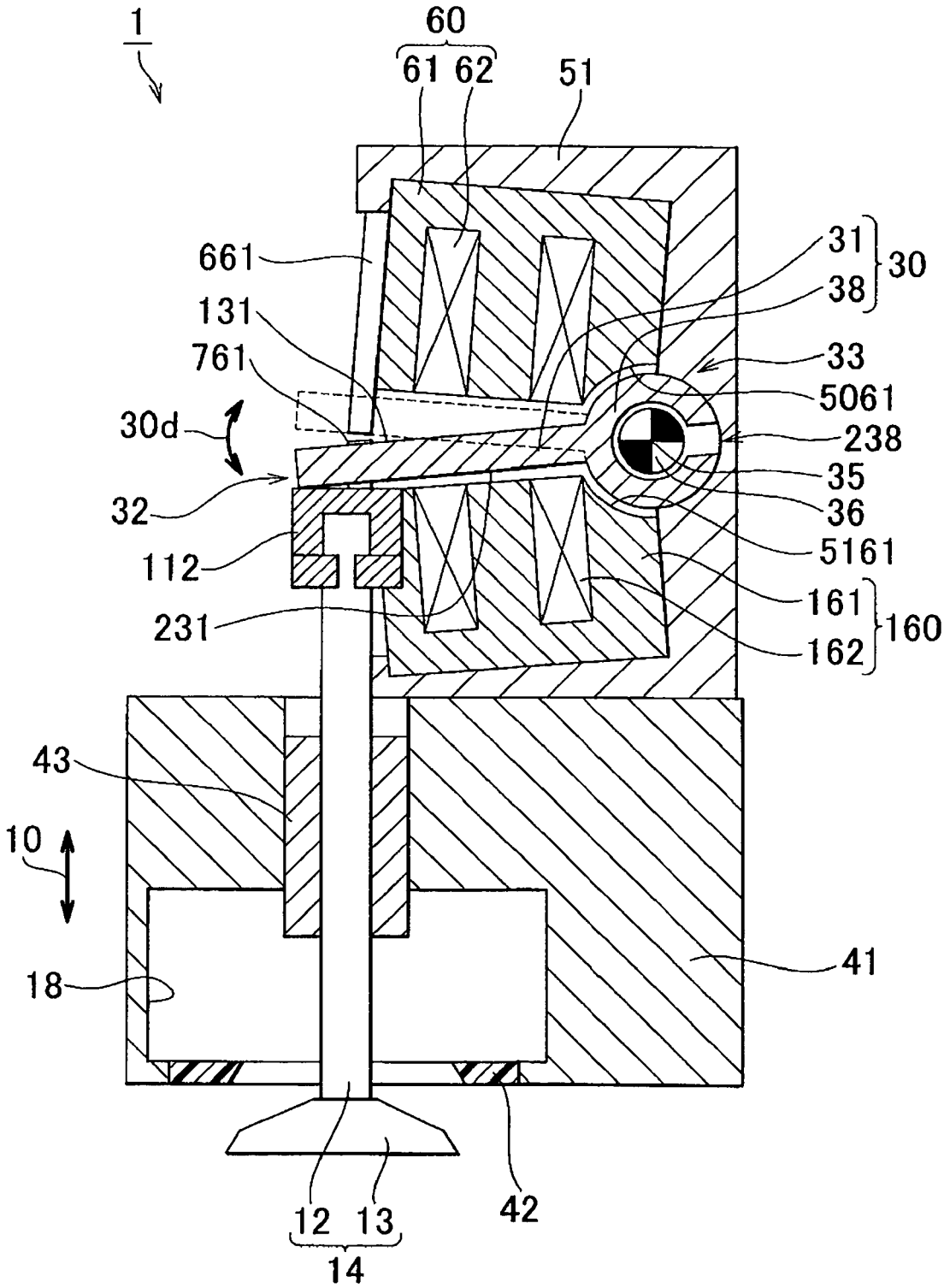
FIG. 11 is a cross-sectional view of an electromagnetically driven valve according to a fourth embodiment.
Figure 12:
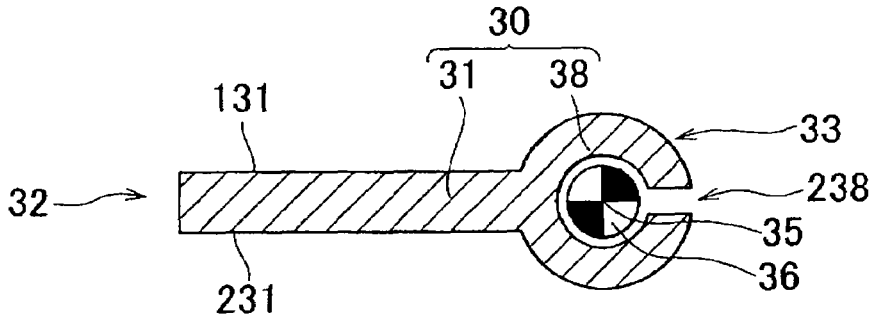
FIG. 12 is an enlarged cross-sectional view of a disc shown in FIG. 11.

FIG. 11 is a cross-sectional view of an electromagnetically driven valve according to a fourth embodiment of the invention. FIG. 12 is an enlarged view of a disc shown in FIG. 11. As shown in FIG. 11 and FIG. 12, the electromagnetically driven valve 1 according to the fourth embodiment is different from the electromagnetically driven valve according to the first embodiment in that a slit 238 is formed in the bearing portion 38. By forming the slit 238, a portion of the bearing portion 38 is completely cut off, and the torsion bar 36 is exposed. The bearing portion 38 has a C-shape cross section. The slit 238 is formed in the cylindrical bearing portion 38 at a portion on the side opposite to the arm portion 31. The slit 238 prevents generation of a magnetic field around the torsion bar 36 and the central axis 35. The slit 238 also prevents generation of a magnetic field that flows to the rear side of the bearing portion 38 (i.e., the side opposite to the arm portion 31).

Figure 13:
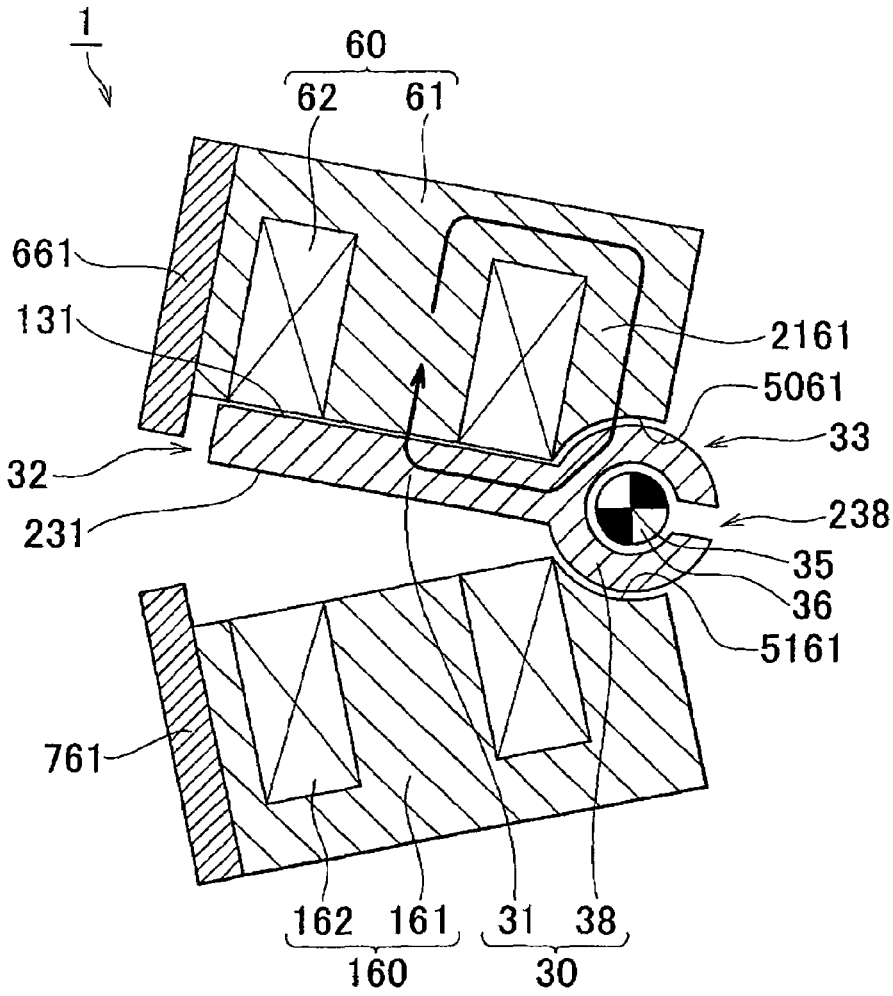
FIG. 13 is a cross-sectional view describing operation of the electromagnetically driven valve shown in FIG. 11.

FIG. 13 is a cross-sectional view describing the operation of the electromagnetically driven valve shown in FIG. 11. As shown in FIG. 13, when the disc 30 is attracted to the upper electromagnet 60, the magnetic field that passes through the core 61, the bearing portion 38, and the arm portion 31 is moved upward. At this time, the magnetic flux that passes through the bearing portion 38 does not flow to the rear side of the bearing portion 38 where the slit 238 is formed (i.e., the area behind the torsion bar 36). Therefore, magnetic flux leakage can be prevented and the electromagnetic force can be increased. The magnetic flux leakage is also reduced by the slit 238 when the disc 30 is attracted to the lower electromagnet 160.

Figure 14:
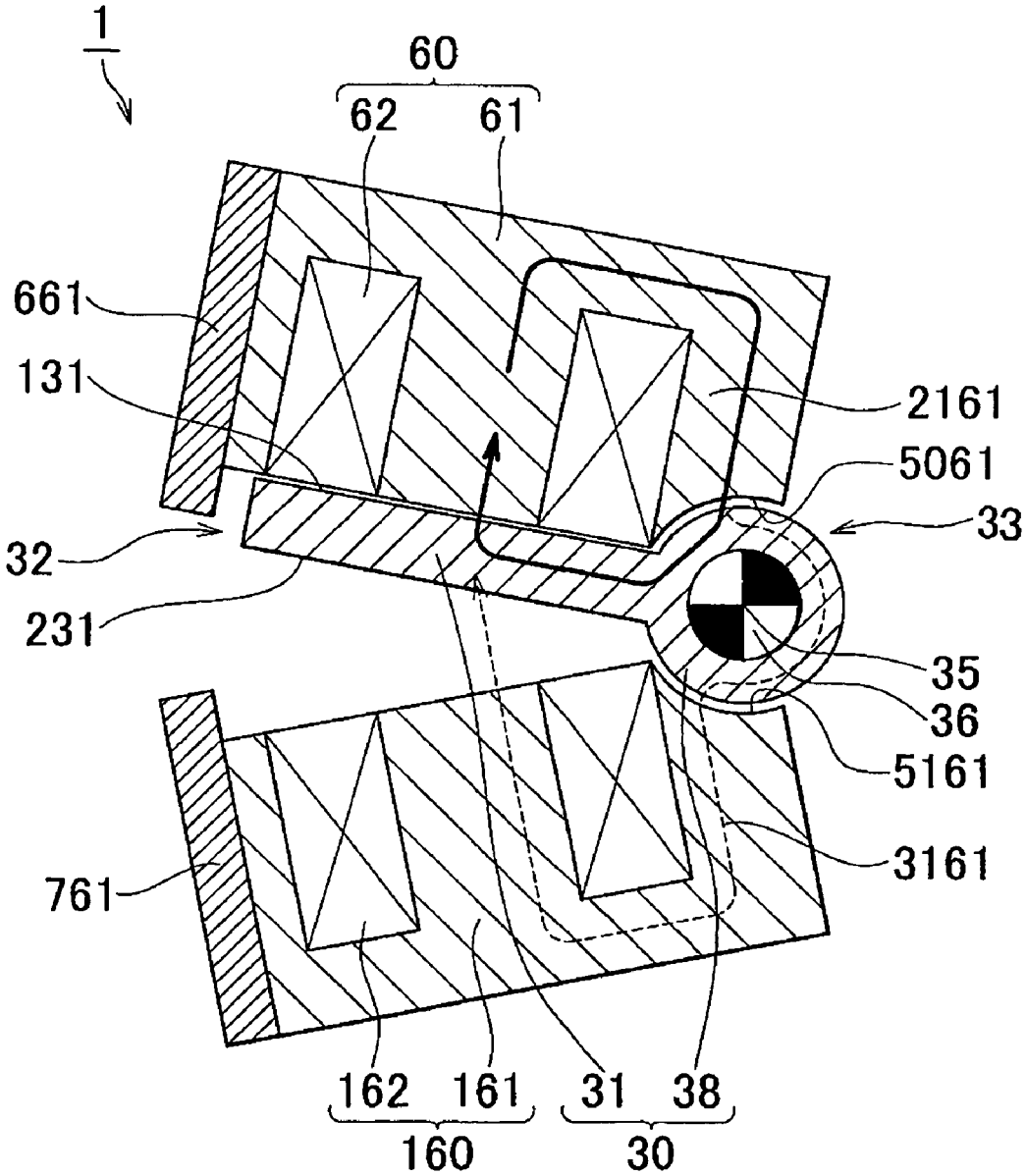
FIG. 14 is a cross-sectional view of another electromagnetically driven valve.

FIG. 14 is a cross-sectional view of another electromagnetically driven valve. FIG. 14 shows the case where a slit is not formed, allowing magnetic flux to leak as shown by a dashed line, and a magnetic circuit 2161 to be generated. The lower electromagnet 160 is about to attract the disc 30 due to the magnetic flux leakage as shown by the dotted lines. This may reduce the electromagnetic force.

In the electromagnetically driven valve having the aforementioned configuration according to the fourth embodiment, by forming the slit 238 on the external side of the bearing portion 38, the magnetic flux leakage can be reduced, the electromagnetic force can be increased, and the amount of consumed electric power can be reduced.

Figure 15:
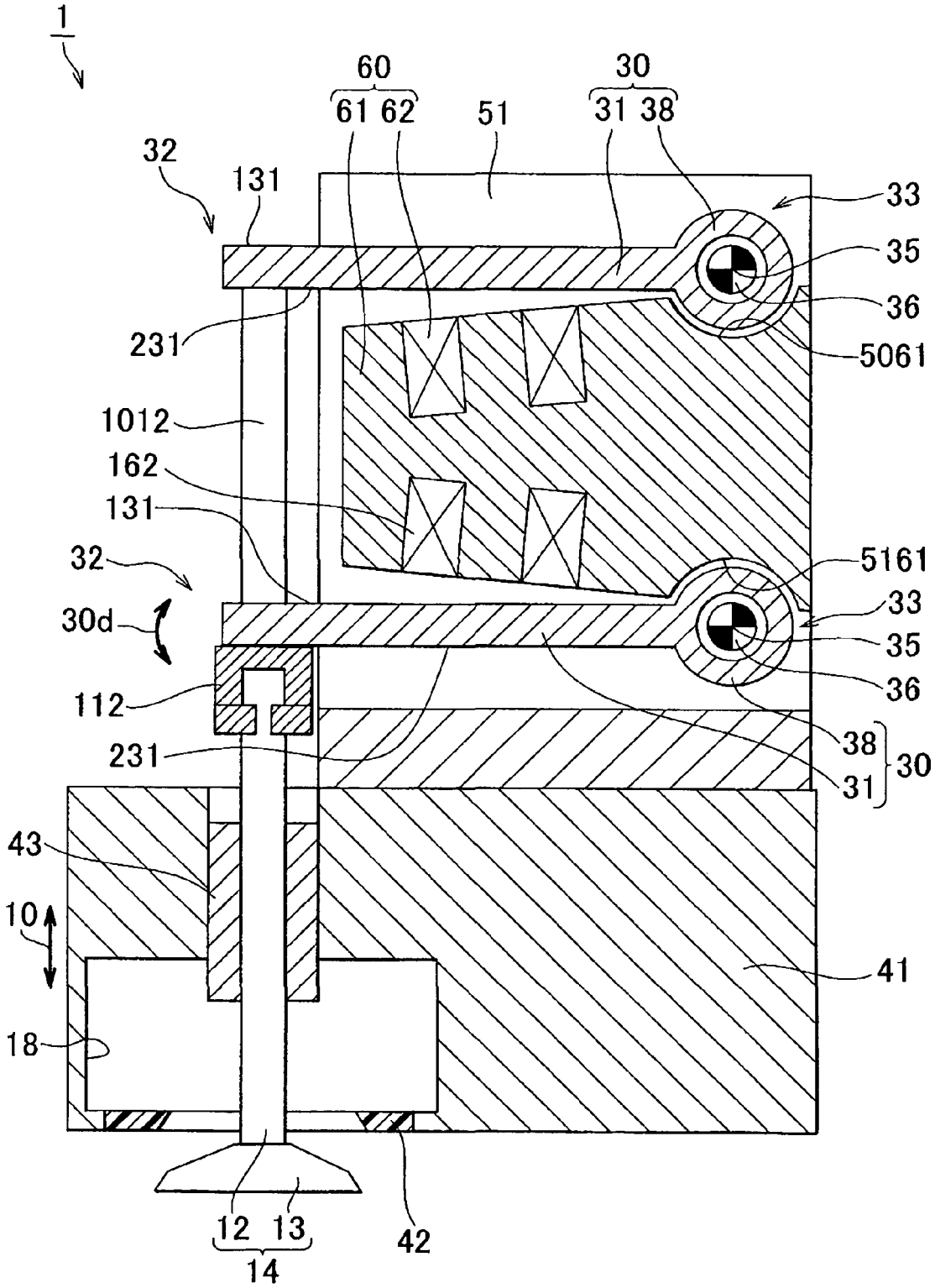
FIG. 15 is a cross-sectional view of an electromagnetically driven valve according to a fifth embodiment.

FIG. 15 is a cross-sectional view of an electromagnetically driven valve according to a fifth embodiment. As shown in FIG. 15, the electromagnetically driven valve 1 according to the fifth embodiment is different from the electromagnetically driven valve 1 according to the first embodiment in that two discs 30, which are an upper disc and a lower disc, are provided. The two discs 30 are connected to each other by a stem 1012. Each of the cylindrical surfaces 5061 and 5161 faces the cylindrical bearing portion 38.

The electromagnetically driven value 1 according to the fifth embodiment has the same effect as that of the electromagnetically driven valve 1 according to the first embodiment.

Although the embodiments of the invention have been described, various modifications may be made to the embodiments. In each of the first to fourth embodiments, one disc 30 is used. However, in each of the first to fourth embodiments, two discs 30 may be used as in the fifth embodiment.

The coil 62 that constitutes the upper electromagnet 60 may be composed of one coil, or a plurality of coils. The coil 162 that constitutes the lower electromagnet 160 may similarly be composed of one coil, or a plurality of coils.

Thus, the embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

The invention can be used in the field of an electromagnetically driven valve for an internal combustion engine that is provided, for example, in a vehicle.

What is claimed is:

1. An electromagnetically driven valve that is operated by an electromagnetic force, comprising:

a valve element which includes a valve shaft, and which is reciprocated in a direction in which the valve shaft extends;

an oscillating member which extends from a driving end, that is moved in conjunction with the valve shaft, to a pivoting end, and which is oscillated around a central axis that extends at the pivoting end;

a support member that supports the oscillating member; and an electromagnet that is disposed so as to face the oscillating member, wherein the electromagnet includes a core made of magnetic material, and a coil wound in the core, wherein the central axis is surrounded by a cylindrical portion of the oscillating member, which is made of magnetic material, wherein the core has a cylindrical portion that faces the cylindrical portion of the oscillating member; and wherein the electromagnet includes an upper electromagnet that is positioned above the oscillating member and a lower electromagnet that is positioned below the oscillating member;

a protrusion made of magnetic material, which extends toward the oscillating member, is provided in each of the cores of the upper electromagnet and the lower electromagnet at a portion on a driving end side; and when the oscillating member is placed at a neutral position, a distance between the cylindrical portion of the oscillating member and the cylindrical portion of the core of the upper electromagnet is different from a distance between the cylindrical portion of the oscillating member and the cylindrical portion of the core of the lower electromagnet, and a distance between the protrusion provided in the core of the upper electromagnet at the portion on the driving end side and the oscillating member is different from a distance between the protrusion provided in the core of the lower electromagnet at the portion on the driving end side and the oscillating member.

2. The electromagnetically driven valve according to claim 1, wherein a distance between the cylindrical portion of the oscillating member and the cylindrical portion of the core changes as the oscillating member is oscillated.

3. The electromagnetically driven valve according to claim 1, wherein a slit is formed in the cylindrical portion of the oscillating member.

4. The electromagnetically driven valve according to claim 1, wherein the distance between the cylindrical portion of the oscillating member and the cylindrical portion of the core of the upper electromagnet is smaller than the distance between the cylindrical portion of the oscillating member and the cylindrical portion of the core of the lower electromagnet.

5. The electromagnetically driven valve according to claim 1, wherein the cylindrical portion of the oscillating member includes a concave portion having a reduced external diameter.

6. The electromagnetically driven valve according to claim 1, wherein the cylindrical portion of the oscillating member includes a concave portion having a reduced external diameter.

7. The electromagnetically driven valve according to claim 6, wherein the distance between the cylindrical portion of the oscillating member and the cylindrical portion of the core of the upper electromagnet is smaller than the distance between the cylindrical portion of the oscillating member and the cylindrical portion of the core of the lower electromagnet.

8. An electromagnetically driven valve that is operated by an electromagnetic force, comprising:

a valve element;

a support member;

an oscillating member including a cylindrical portion that is made of a magnetic material and that oscillates about a central axis, said oscillating member being supported by said support member, and operable to move in conjunction with said valve element; and an electromagnet disposed so as to face the oscillating member, and including a core made of magnetic material, and a coil wound in the core, wherein the central axis is surrounded by the cylindrical portion of the oscillating member, and wherein the core has a cylindrical portion that faces the cylindrical portion of the oscillating member; and wherein the electromagnet includes an upper electromagnet that is positioned above the oscillating member and a lower electromagnet that is positioned below the oscillating member;

a protrusion made of magnetic material, which extends toward the oscillating member, is provided in each of the cores of the upper electromagnet and the lower electromagnet at a portion on a driving end side; and when the oscillating member is placed at a neutral position, a distance between the cylindrical portion of the oscillating member and the cylindrical portion of the core of the upper electromagnet is different from a distance between the cylindrical portion of the oscillating member and the cylindrical portion of the core of the lower electromagnet, and a distance between the protrusion provided in the core of the upper electromagnet at the portion on the driving end side and the oscillating member is different from a distance between the protrusion provided in the core of the lower electromagnet at the portion on the driving end side and the oscillating member.

9. The electromagnetically driven valve according to claim 8, wherein a distance between the cylindrical portion of the oscillating member and the cylindrical portion of the core changes as the oscillating member is oscillated.

10. The electromagnetically driven valve according to claim 8, wherein a slit is formed in the cylindrical portion of the oscillating member.

11. The electromagnetically driven valve according to claim 8, wherein a slit is formed in the cylindrical portion of the oscillating member.

12. The electromagnetically driven valve according to claim 8, wherein the distance between the cylindrical portion of the oscillating member and the cylindrical portion of the core of the upper electromagnet is smaller than the distance between the cylindrical portion of the oscillating member and the cylindrical portion of the core of the lower electromagnet.

13. The electromagnetically driven valve according to claim 8, wherein the cylindrical portion of the oscillating member includes a concave portion having a reduced external diameter.

14. The electromagnetically driven valve according to claim 11, wherein the distance between the cylindrical portion of the oscillating member and the cylindrical portion of the core of the upper electromagnet is smaller than the distance between the cylindrical portion of the oscillating member and the cylindrical portion of the core of the lower electromagnet.

* * * * *